US009486850B2

(12) United States Patent
Buta

(10) Patent No.: US 9,486,850 B2
(45) Date of Patent: Nov. 8, 2016

(54) ROLLER LEVELER

(71) Applicant: John R. Buta, Salem, OH (US)

(72) Inventor: John R. Buta, Salem, OH (US)

(73) Assignee: Butech Bliss, Salem, OH (US)

( * ) Notice: Subject to any disclaimer, the term of this patent is extended or adjusted under 35 U.S.C. 154(b) by 75 days.

(21) Appl. No.: 14/099,273

(22) Filed: Dec. 6, 2013

(65) Prior Publication Data

US 2014/0157850 A1 Jun. 12, 2014

Related U.S. Application Data

(60) Provisional application No. 61/734,618, filed on Dec. 7, 2012.

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21D 1/05; B21D 3/05; B21B 1/222; B21B 2015/0071; B21F 1/02
See application file for complete search history.

(56) References Cited

U.S. PATENT DOCUMENTS

| | | | | |
|---|---|---|---|---|
| 4,633,697 | A * | 1/1987 | Blough | 72/164 |
| 5,855,132 | A * | 1/1999 | Cozzi | 72/160 |
| 2009/0113973 | A1* | 5/2009 | Cox, III | 72/165 |
| 2009/0282883 | A1* | 11/2009 | Noe | B21D 1/05 72/160 |

* cited by examiner

*Primary Examiner* — Teresa M Ekiert
(74) *Attorney, Agent, or Firm* — Fay Sharpe LLP

(57) ABSTRACT

A roller leveler for leveling strips of metal has a frame, a bank of upper and lower work rolls journalled in the frame via a housing positioned toward an exit portion of the leveler. A bank of upper and lower back-up rolls is in contact with the upper and lower work rolls to support the work rolls. The bank of upper and lower back-up rolls mounted to the frame via back-up housings. A second bank of upper and lower work rolls is positioned near an entry portion of the leveler. The first bank of upper and lower rolls has rolls of different diameter than the second bank of upper and lower work rolls. A roll or rolls can be mounted in an eccentric fashion that is achieved by permanent or adjustable positioning of offset of the work roll with respect to adjacent rolls or by providing a work roll that is larger in diameter than its adjacent rolls.

14 Claims, 10 Drawing Sheets

$$\text{STRAIN} = \frac{\Delta L}{L}$$

$$\text{STRAIN} \quad Ys = \frac{t}{2R}$$

$$R = \frac{t \cdot E}{2 \cdot Ns \cdot Ys}$$

Ns = NO. OF YIELD STRAINS

ROLLER LEVELER

CLAIM OF PRIORITY

This application claims priority from U.S. Provisional Application Ser. No. 61/734,618, filed on Dec. 7, 2012, the entirety of which is hereby incorporated by reference.

BACKGROUND OF THE DISCLOSURE

The disclosure relates to roller levelers. It finds particular application in conjunction with roller levelers with independent work roll drive systems and various diameter eccentric work roll configurations, and will be described with particular reference thereto. However, it is to be appreciated that the present embodiment is also amenable to other like applications.

A roller leveler is used to achieve material flatness by precisely bending metal strip back and forth as it is passed through a series of offset work rolls to make the metal's surface flat, wave-free and to neutralize hidden internal stresses that cause twist and roll during secondary operations (e.g., stamping). The gap between the work rolls is set independently on a leveler's entry and exit. To begin leveling the metal, it is deeply "nested" upon entering the rolls—thereby forcing the material to plunge through extreme angles, removing strip memory caused by trapped internal stresses. Adjustable pressure points called flights under the rolls are used to raise and lower the rolls to a specific position—thus altering the material path length through the leveler and allowing the material to be stretched more because more work is being performed on it as it passes through the rolls.

A roller leveler typically includes multiple pairs of offset work rollers or rolls. Different size levelers can have different quantities of work rolls and back-up rolls. The upper rolls are typically offset one-half the distance between a pair of adjacent lower rolls. The metal strip passes between the upper and lower rolls. The number and spacing of the rolls depend on the thickness and strength of the metal strip. Typically, as the strip thickness decreases, the spacing of the rolls, as well as the roll diameter, decrease. As the strip passes between the rolls, it is bent up and down multiple times before it exits the leveler. The severity of the bend is greatest at the entry of the leveler and proportionately decreases towards the exit of the leveler. This reversed bending beyond the yield point of the material is the mechanism whereby the strip is flattened.

Metal is typically formed into strips by a process known as rolling, wherein the strip is passed between a pair of work rolls of a rolling mill to reduce its cross-sectional thickness. In the process, the strip is elongated and rolling continues until the strip is reduced to the cross-sectional thickness desired. This rolling process may start with heated billets or slabs of metal, wherein the metal is rolled at a very high temperature, or it may start with previously rolled strip wherein the strip is passed between work rolls in the cold state. In either event, when the strip exits from the mill, it may be convolutedly wrapped to form a coil. When the coil has been formed, curvature of the coil tends to stay with the strip when it is necessary to uncoil the strip for further processing. Thus, the primary problem with strip coming off of a coil is the curvature which remains with the strip and which varies throughout the entire length of the coil as a function of the radius of any particular portion of the strip while in the coil. Accordingly, the outer wrap of the coil will have less curvature than an inner wrap. To remove this variable curvature in the strip is one of the purposes of a roller leveler. It is necessary to remove this curvature so that the strip may be cut accurately and rendered suitable for other manufacturing operations, such as punching, drawing, forming and the like. It is well established that the flatter the strip is prior to a subsequent manufacturing operation, the more accurate and satisfactory will be the end product of that operation. Thus, even where portions of steel strip are deep drawn, they do not draw as satisfactorily if the strip initially is not substantially flat before the draw.

In addition to strip curvature, other unwanted properties are sometimes impressed upon the strip during hot and/or cold rolling which render the problem of flattening strip much more complex. In order to reduce cross-sectional thickness of the strip during rolling, it is necessary to force the strip between rolls under tremendous pressure whereby the strip essentially becomes a wedge which tends to separate the rolls. The force of roll separation is dependent upon the physical properties of the strip including width, thickness, hardness, temperature, yield strength, and amount of reduction being attempted during the pass of the strip between the rolls. If the work rolls are not sufficiently supported by back-up rolls, it is possible for the strip to actually cause the work rolls to bend at their centers, wherein the resultant strip cross-sectional shape is thicker in the middle than at the edges. Strip rolled with thicker center portions indicates that greater pressure has been applied to the edges of the strip than at the center, thereby causing the edges to elongate at a greater rate than the center of the strip. Because this excess metal on the edges must go somewhere, but is restrained by the center, the result usually is a product having what is referred to as edge waves. In other words, the center of the strip is relatively flat longitudinally, but the edges of the strip are sinusoidal.

A metal strip product is fed into a roller leveler, typically from a coil. Roller levelers use multiple work rolls of various diameters to flatten the strip as it passes through the leveler. The path of the strip passes between offset upper and lower work rolls, in effect reverse bending the strip multiple times before the strip exits the leveler.

A typical roller leveler is designed to process a range of strip thicknesses and strip yield strengths. As the strip passes between the work rolls, very high separating forces are generated against the work roll face, yet the work roll diameters are of necessity relatively small; this is to allow the work rolls to bend and to space them close enough to properly work the strip. The work rolls are supported by flights or groups of back-up rolls. The back-up rolls support the work rolls and prevent them from incurring excessive bending in reaction to the separating forces.

A problem with existing roller levelers is that a single drive system having a drive motor M and reducer R is used for multiple work rolls (see FIG. 1). Existing levelers L utilize distribution boxes D, which mechanically lock their work rolls together at the same fixed speed. However, in the leveler entry work rolls that are plunged deeper than the exit rolls must necessarily rotate at a different speed than the exit rolls. The speed difference of rolls accumulates into windup of the work roll spindles and increases the risk of roll-slippage/strip-marking and spindle or distribution box failure. Existing levelers install slip-clutches to limit windup, but they are expensive to calibrate and costly to stock for spares. If the drive train fails, then the entire leveler system capacity is reduced.

Existing roller levelers have a consistent geometry for the work rolls; meaning all of the work rolls are equally spaced and their outside diameter surfaces are coplanar or lie along the same plane. The aforementioned condition creates a uniform decrease in roll internmesh from the entry to the exit of the leveler. This, in turn, establishes the total horsepower required to do the leveling work. At the entry of the leveler, by altering the pitch between adjacent rolls or by altering the vertical height of adjacent upper rolls or adjacent lower rolls, horsepower requirements can be reduced substantially.

Another problem with existing roller levelers is that multiple diameter work rolls cannot be engaged at the same time. That is, only large work rolls or only small work rolls can engage the work piece but not at the same time. Thus, there is a need for a roller leveler system: i) which is comprised of independent work roll drive systems ii) which provides an eccentric roll configuration that varies the position of an entry roll (or rolls) in relation to the exit rolls which provides up to 20% more shape correction per horsepower, and iii) which provides a roll configuration that allows for large and small work rolls to both engage a work piece at the same time and extends the working gauge range of the leveler without having to change out roll cassettes or without requiring two separate levelers. The roller leveler system of the disclosure overcomes the above-mentioned deficiencies and others while providing better and more advantageous overall results.

SUMMARY OF THE DISCLOSURE

The present disclosure relates to roller levelers. More particularly, it relates to roller levelers with independent work roll drive systems, eccentric work roll configurations, and multiple roll diameters engaging the strip simultaneously.

The nature of leveling is to bend the strip around the most deeply-plunged rolls at the entry end while barely bending it at the exit. This process results in decreasing roll speeds from entry to exit, because the strip has to travel down and up around the entry rolls yet move nearly straight across the exit roll. The deeper the entry plunge setting, the greater the speed differential between the rolls.

Some materials have trapped stresses therein. While trying to cut shapes out of the material, a laser cutter may get to within 1/16 inch of the steel surface. Virtually any movement of the material issued cause damage to the laser while cutting the material internal stresses are released.

Roller levelers are used to remove the elongate stresses in material. In practice, smaller and smaller work rolls are used as steel and other materials become lighter in weight yet stronger.

In accordance with one aspect of the disclosure, a single process line has both large diameter work rolls for heavy gauge material and small diameter work rolls for light gauge material. The work rolls could be placed in series or in an offset configuration, where the work rolls are changed out to change the size of work rolls from large diameter to small diameter as necessary.

In accordance with one aspect of the disclosure, a roller leveler has a frame; a bank of upper and lower work rolls journalled in the frame via a work roll journal housing; and a bank of back-up rolls in contact with the work rolls to support the work rolls. The work rolls perform leveling on a work piece passing through a gap formed between upper and lower work rolls. The back-up rolls are mounted to the roller leveler frame via a back-up housing. The back-up rolls are movable to allow a first bank of work rolls to be removed and a second bank of work rolls to be installed. The second bank of work rolls includes work rolls of a different diameter and can be smaller or larger than the first bank of work rolls. The leveler provides the highest degree of flatness and memory reduction. The leveler system utilizes individual work roll drives, such that the unlikely failure of one or more work roll drive trains only marginally reduces leveler capacity, allowing your line to continue operating so that maintenance can be performed at a time that will not interfere with production requirements.

In accordance with another aspect of the disclosure, the work rolls each have an independent work roll drive system and an eccentric or offset work roll configuration formed of large and small diameter work rolls that provides up to 20% more shape correction per horsepower and extends the working gauge range of the leveler without having to change out roll cassettes or without requiring two separate levelers.

Another aspect of the disclosure is each work roll has its own motor and independent gear reduction allowing each roll to load share and turn at the exact speed dictated by the roll's plunge setting. Distribution box and spindle wind up is a problem for other pinion stand and split pinion stand levelers, but not for the roller leveler of the present disclosure. The leveler doesn't require mechanically locked sets of gears, but instead uses common off-the-shelf or commercially available lower horsepower motors and independent gearing.

Another aspect of the disclosure is an eccentric work roll configuration in which some work rolls can be offset relative to adjacent work rolls and some work rolls are of a large diameter and some are smaller diameter. Yet another aspect of the disclosure is the ability to engage large and small work rolls with a single work piece (or strip) at the same time.

In accordance with another aspect of the disclosure, a roller leveler for leveling strips of metal has a frame, a bank of upper and lower work rolls journalled in the frame via a housing positioned toward an exit portion of the leveler, a bank of upper and lower back-up rolls in contact with the upper and lower work rolls to support the work rolls, the bank of upper and lower back-up rolls mounted to the frame via back-up housings; a second bank of upper and lower bank rolls positioned near an entry portion of the leveler, wherein the first bank of upper and lower rolls has a different diameter than the second bank of upper and lower work rolls.

In accordance with another aspect of the disclosure, a roller leveler has a frame; a first bank of upper work rolls of a first diameter adjacent an exit point of the leveler; a second bank of upper work rolls of a second diameter less than the first diameter; the second bank is adjacent the exit point; a third bank of lower work rolls of the first diameter; adjacent the exit point of the leveler; and a fourth bank of upper and lower work rolls of a third diameter which is less than the first diameter; the fourth bank is adjacent an entry point of the leveler wherein the second bank of work rolls comprises a number of rolls which is less than a number of rolls in the third bank wherein the second bank and the third bank of work rolls forms an offset roll configuration; and wherein the fourth bank of work roll engages a workpiece of light gauge metal and does not engage a workpiece of heavy gauge metal.

Another aspect of the disclosure is a roller leveler having a frame; a first bank of upper and lower work rolls of a first diameter positioned adjacent an entry point of the frame; and a second bank of upper and lower work rolls of a second diameter larger than the first diameter; the second bank of upper and lower work rolls is adjacent the entry point of the frame.

Still other aspects and features of the disclosure will become apparent to those skilled in the art from a study of the detailed descriptions of the preferred embodiments set forth herein and illustrated in the accompanying drawings.

BRIEF DESCRIPTION OF THE DRAWINGS

Further aspects of the disclosure will become apparent by reference to the detailed description when considered in conjunction with the figures, wherein like reference numbers indicate like elements through the several views, and wherein.

DETAILED DESCRIPTION OF THE DISCLOSURE

One of the primary functions of a roller leveler is to remove curvature from a piece of metal strip, sheet or plate. Strip is defined to mean metal which is sufficiently narrow and is rolled sufficiently thin that it can be wrapped into a coil. A sheet is defined as metal that is, for whatever reason, cut into lengths rather than stored in coiled form. Plate is metal which is too thick, as a practical matter, to be formed into a coil.

The other important use of roller levelers is to make corrections in the shape of strip as it comes from the rolling mill. When strip is passed between the rolls of a rolling mill, tremendous pressures are exerted against the rolls tending to force them apart. When this occurs, the strip tends to be rolled thinner at the edges than in the center portion. The difference between the thickness of the edges of the strip and of the center of the strip may be only a few thousandths of an inch or less. When this condition occurs, the edges of the strip are thinner, because more metal has been rolled in these areas than in the center portion, resulting in edges which are longer than the center portion of the strip. As a consequence, since the edges of the strip are restrained from elongating by the shorter thicker center portion of the strip, these edges respond to this restraint by forming into edge waves. Strip may also be rolled with the center portion thinner than the edge portions.

Figure 2:
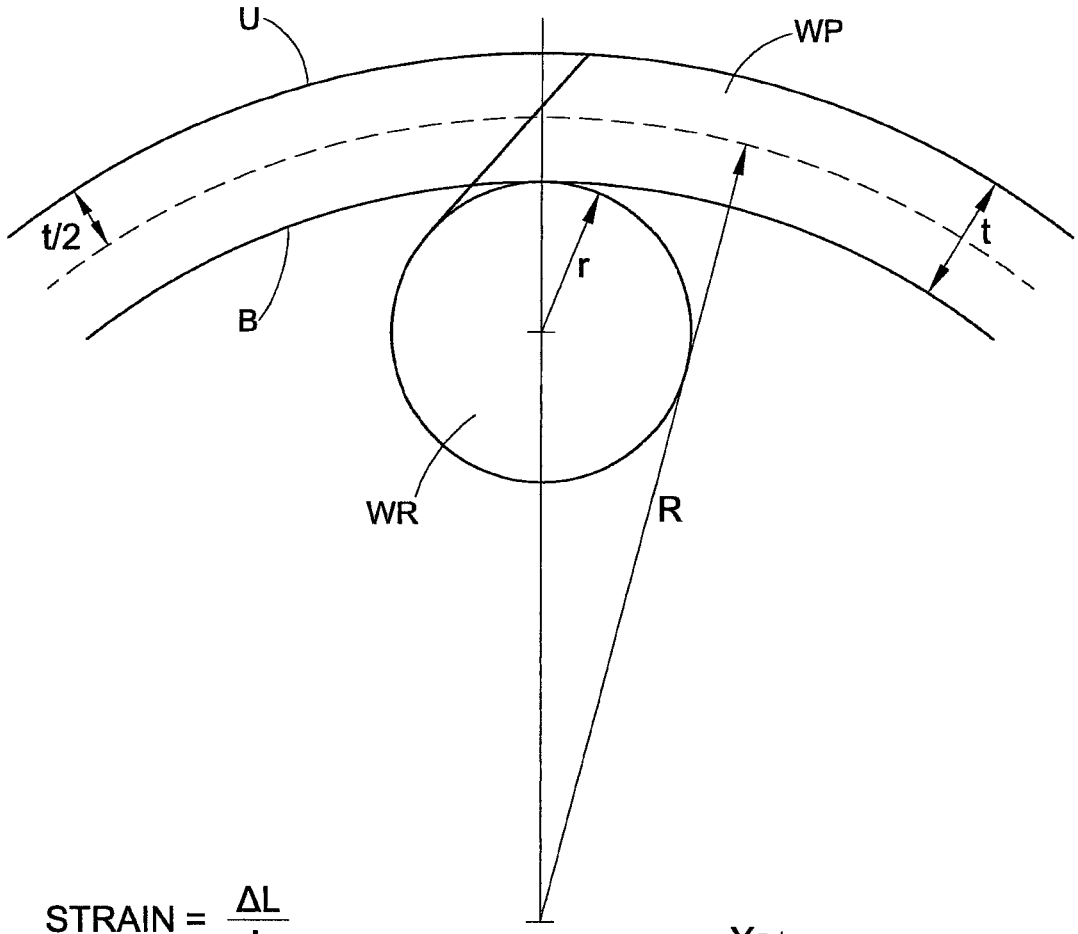
FIG. 2 is a schematic of the bend radius of the work piece and the work roll radius in comparison to yield stress and yield strain.
Figure 2:
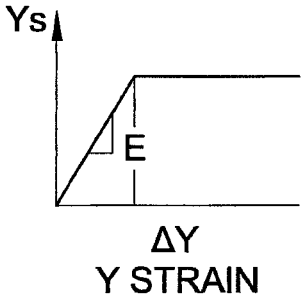

Referring now to FIG. 2, as the work piece WP passes through the leveler, there is a bend radius R associated with the material where the materials is in tension at an upper end U and is in compression at the bottom end B. The tighter the bend radius, the larger the strain in the material, where strain equals the change in length ($\Delta L$) divided by length (L), i.e., $\Delta L/L$. Radius R is calculated as t (thickness of material) times E (Young's Modulus) divided by 2 times the number of yield strains (Ns) times Ys.

The smaller the bend radius R of the material, the more work is required of the work rolls WR. The radius of the work roll, r, is necessarily limited by the radius of the work piece R. Yield strain (Ys) in the material at an outer end is defined by the half thickness t of the material divided by the bend radius R; i.e., $Ys=t/2R$.

In accordance with a preferred embodiment of the disclosure, a roller leveler has a series of work rolls which have increasing radii along the length of the leveler. For example, the size of each work roll can vary from about 5 inches in diameter at the entry point to about 50 inches in diameter at the exit point.

Existing roller levelers have clusters of small and large diameter work rolls but the small and large diameter work rolls are not used all at the same time. That is, either small or large diameter work rolls are used with the work piece, but not all at the same time.

The preferred embodiment is directed to a roller leveler which has small work rolls which transition to large work rolls and wherein the large and small work rolls can be used at the same time. For example, for light gauge material, all of the work rolls are used. For heavy gauge materials, only the large diameter rolls are used. The small diameter rolls are physically shifted out of leveling path. The small diameter rolls and large diameter rolls necessarily rotate at a different RPM.

Furthermore, each work roll has its own independent work roll drive system without having to change out roll cassettes or without requiring two separate levelers.

Existing levelers utilize distribution boxes, which mechanically lock their work rolls together at the same fixed speed. The speed difference of rolls accumulates into windup of the work roll spindles and increases the risk of roll-slippage/strip-marking and spindle or distribution box failure. Some levelers install slip-clutches to limit windup, but they are expensive to calibrate and costly to stock for spares.

Figure 1:
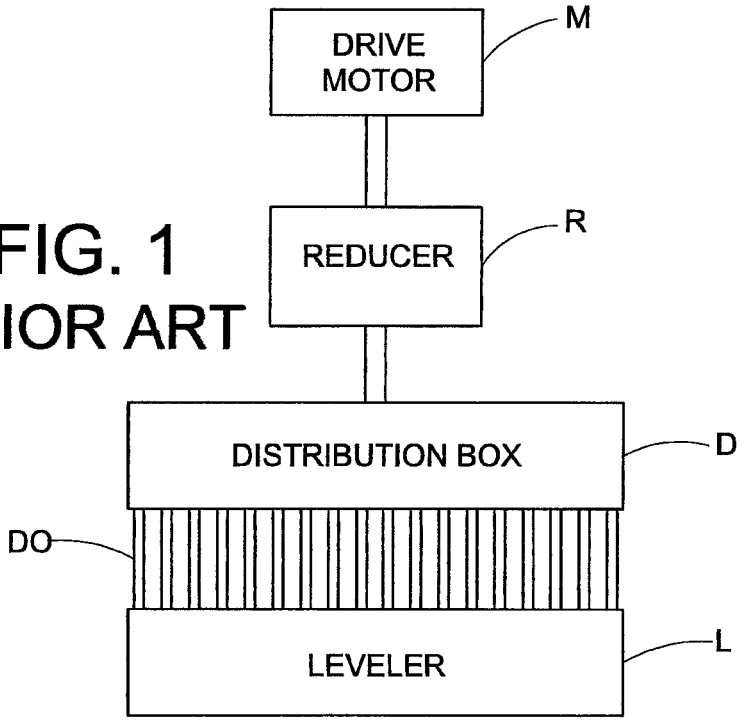
FIG. 1 PRIOR ART
FIG. 1 is a schematic of a traditional roller leveler system having one drive motor for multiple work rolls.

In a traditional roller leveler drive train such as shown in FIG. 1, there is a single distribution box D with a single input and multiple drive outputs DO. As an example, there can be seventeen output drive shafts DO wherein all of the work rolls rotate all at the same speed.

As an example, an input of a typical 500 horsepower distribution over seventeen outputs would result in about 30 hp per work roll. Referring to FIG. 1, a drive motor M, a reducer R and a distribution box D feed the horsepower to the seventeen work rolls. Each work roll will rotate at the same RPM. This can result in slipping and jamming of the rolls.

In the present disclosure, each work roll has its own independent drive system including a drive shaft, motor and reducer combination. Each work roll rotates at different speeds depending on the diameter of the work roll. Work rolls can vary in diameter from, for example, 3 inches to 6.75 inches in diameter or more.

Another aspect of the disclosure is the work rolls are configured in an eccentric or offset orientation, which required less horsepower to rotate the work rolls, and thereby reduces energy costs. Also, an even or odd number of work rolls can be configured on the upper end of the leveler, while an odd or even number of work rolls can be configured for the lower end of the leveler. The number of upper work rolls is thereby different from the number of lower work rolls. The tightest radius is formed at the beginning of the leveler, and the radius becomes larger (i.e., looser) toward the end of the leveler. The work rolls can be moved out of the leveling path if necessary.

In an eccentric configuration, some work rolls, preferably one of the large work rolls, can be raised or lifted up or lowered out of contact with the metal strip or work pieces, depending on the lightness or heaviness of the metal strip or work pieces. Alternatively, the diameter of one of the large work rolls can be increased in lieu of lowering or raising the roll. For light gauge material, all work rolls are active or engaged. For heavy gauge material, the large rolls are active or engaged while the small rolls are left open or moved out of the travel path of the strip. The small rolls can be positioned above the large work rolls or in series with the large work rolls.

Figure 3:
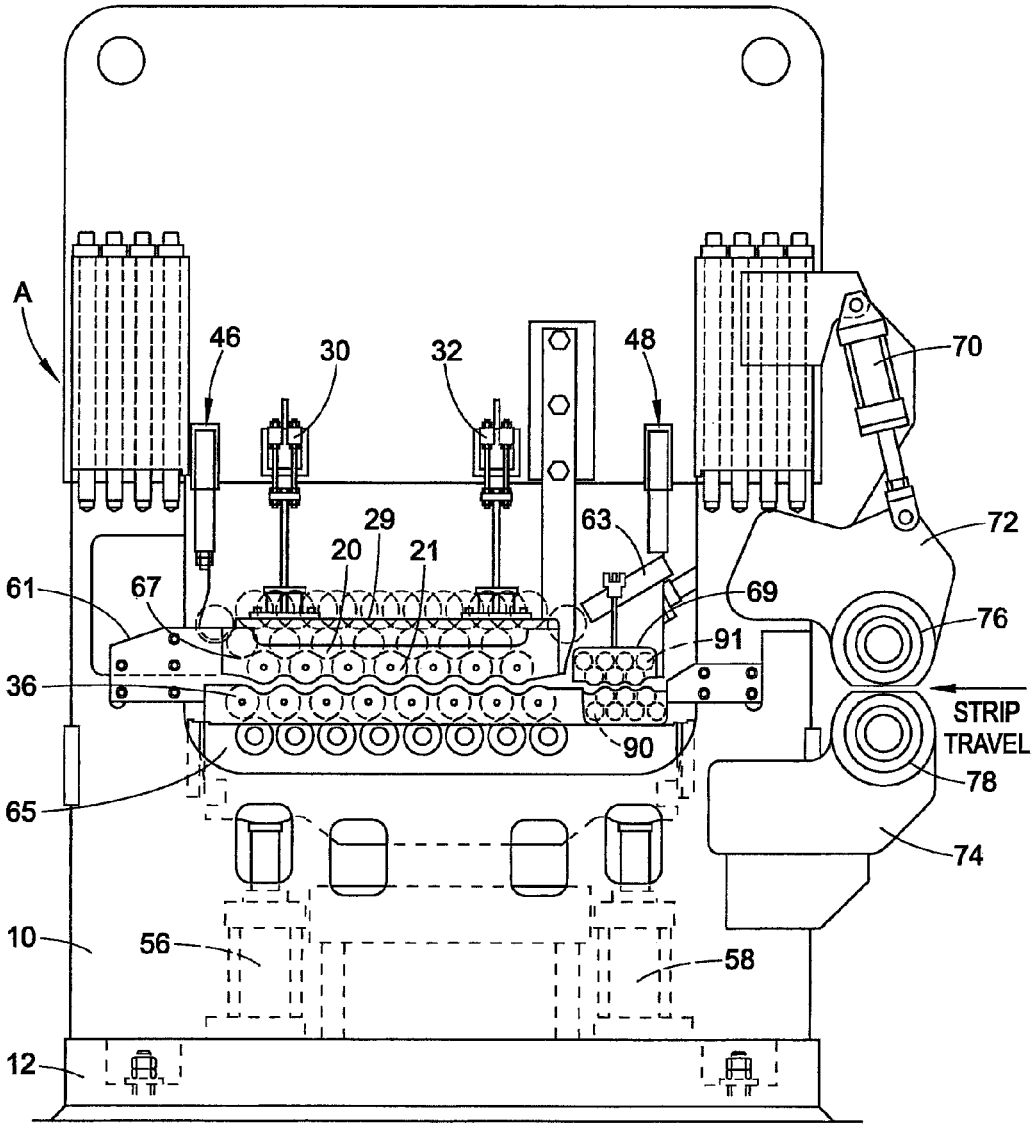
FIG. 3 is a side elevational view of a roller leveler of the present disclosure in accordance with a preferred embodiment.
Figure 4:
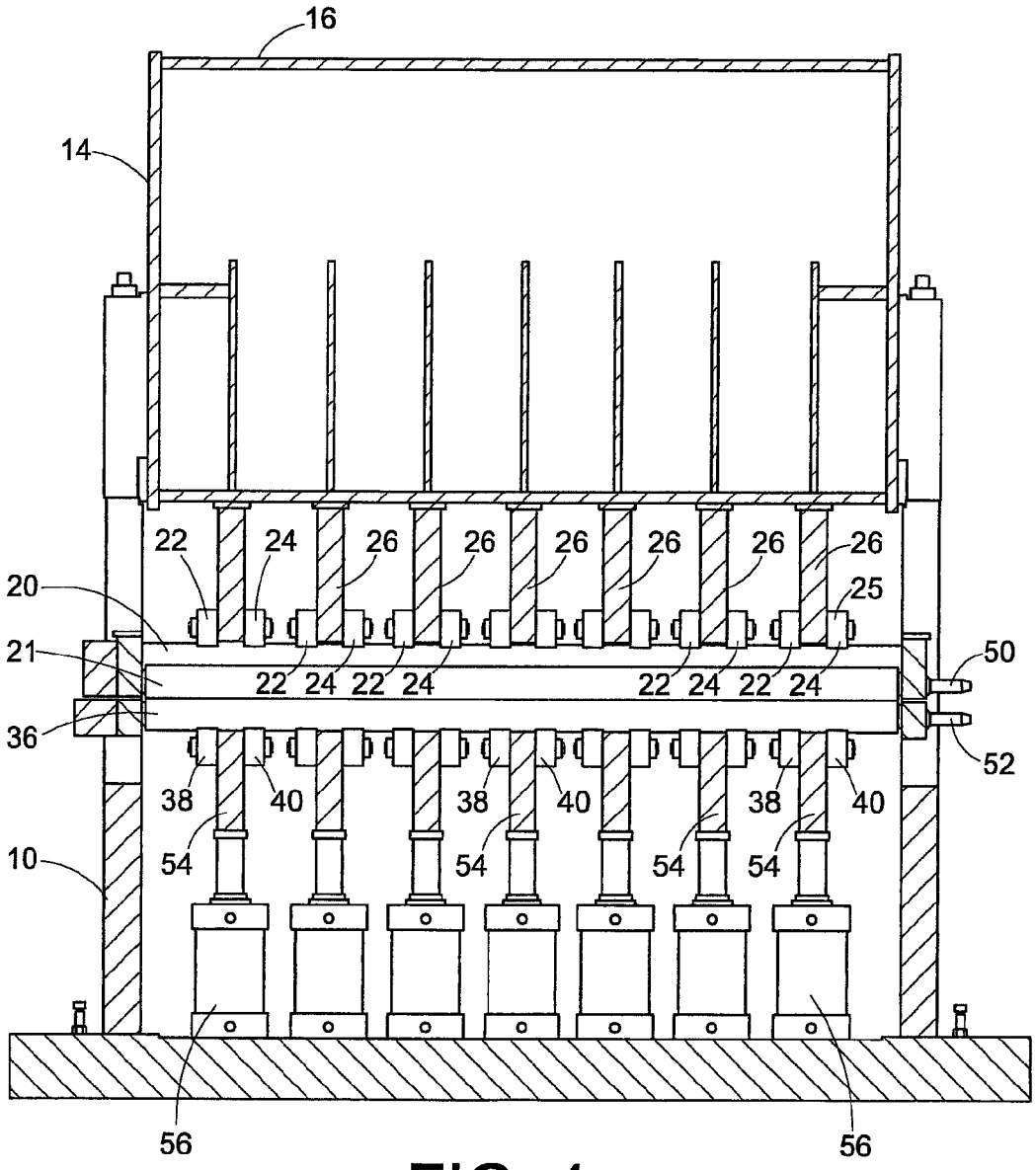
FIG. 4 is a front cross-section elevational view of the roller leveler of FIG. 3.

Referring now to the Figures in greater detail, and in particular to FIGS. 3-9, therein is shown a roller leveler A comprising a weldment frame having steel side slabs 10, welded to base slab 12 to form the lower half of the frame. As best shown in FIG. 4, the upper half of frame 10 comprises upper slabs 14 welded to slabs 16.

Figure 5:
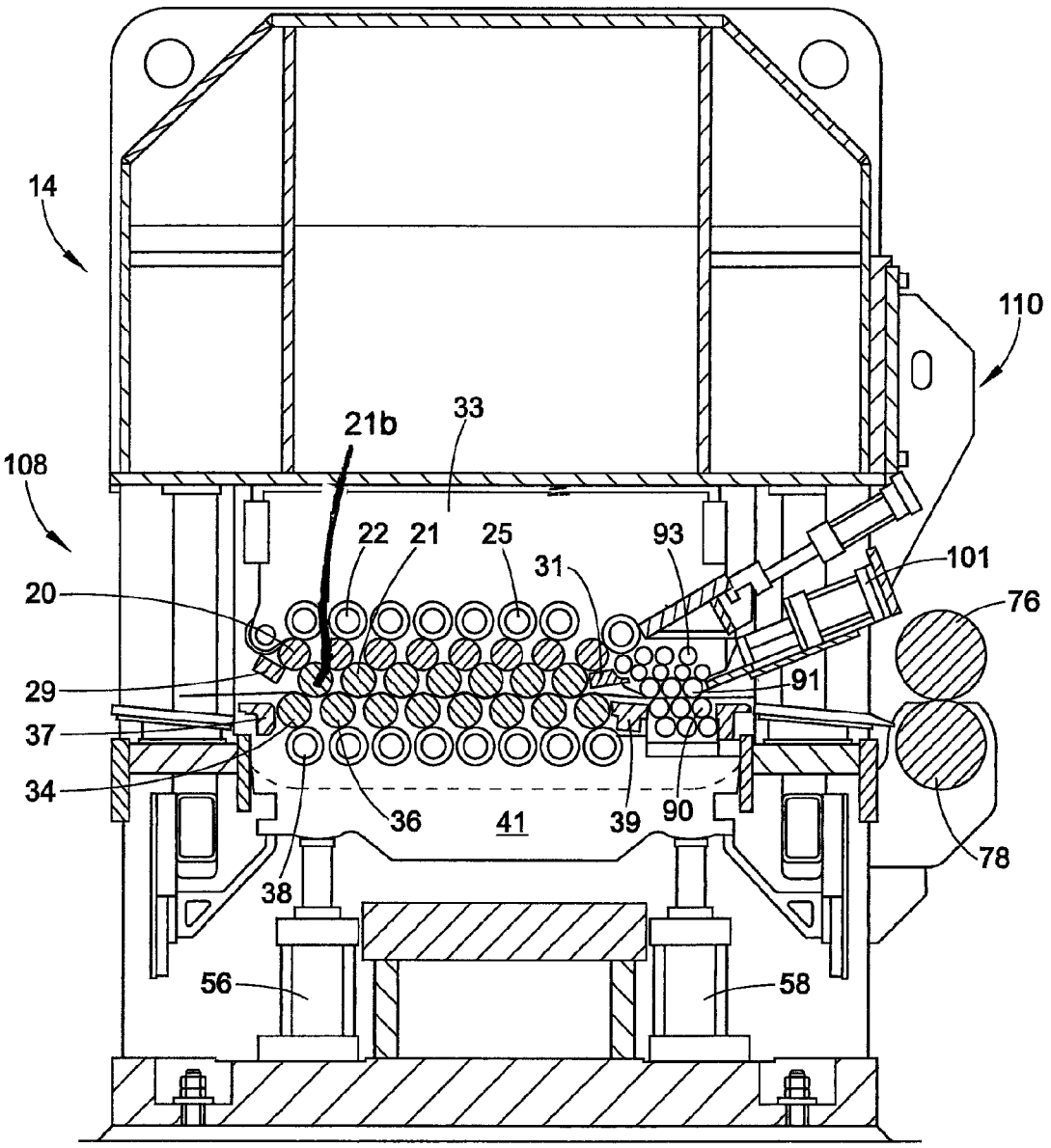
FIG. 5 is a side cross-sectional view of the leveler of FIG. 3.
Figure 5A:
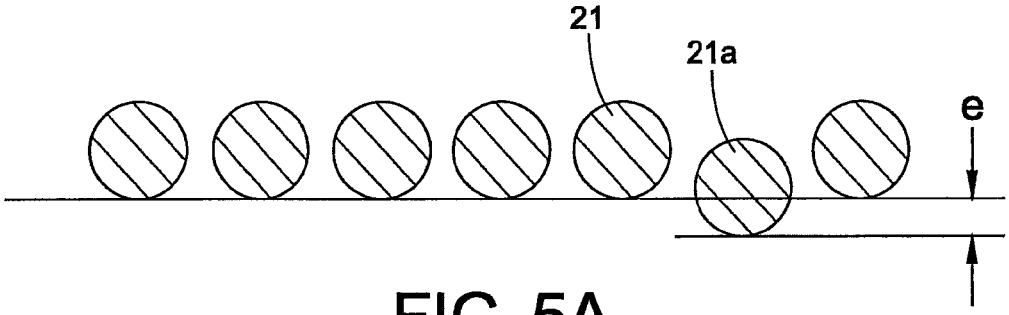
FIG. 5A illustrates an eccentric work roll configuration for upper work rolls.

Referring to FIGS. 4 and 5, roller leveler assembly A has upper, small diameter intermediate work rolls 20 and upper, large diameter work rolls 21 (in bank 21*b*) in their operating position and upper back-up rolls 22, 24 in working position to ride and support the outer diameter of the work rolls. In FIG. 5, two of the large work rolls 21 are shaded, these rolls are near the entry end 110 of the leveler. Referring to FIG. 5A, these upper work rolls or one of these rolls 21*a* can be moved (i.e., displaced vertically) and independently of the adjacent rolls 21. The object is to cause these rolls to have a tighter intermesh between upper and lower rolls. This forms an eccentric, or offset roll configuration whereby in the zone of the shaded rolls the strip is bent to a tighter radius than would otherwise be possible. This results in more yield strains (higher bending work) than otherwise, thereby reducing the overall work in the leveler. This also results in more shape correction per horsepower.

The eccentric effect can be best explained as follows. In a typical leveler the upper work rolls are all evenly spaced, all the rolls are the same diameter, and all the rolls are mounted on the same plane. The lower rolls are also the same diameter as the upper rolls and they are on the same center distances as the upper rolls and the lower rolls are all mounted on their same plane. The upper rolls are offset to the lower rolls by ½ the pitch of the rolls. When the rolls are in operating position, at the entry, there is a gap between the upper and lower rolls. The gap can be a positive gap for heavy gauge strip, or a negative gap for light gauge strip. The roll gap establishes the bend radius that is imparted to the strip. The deeper the plunge between the upper and lower rolls the tighter the bend radius in the strip. The tighter the bend radius in the strip, the more strain resulting in more rapid correction of the strip flatness.

The exit rolls are typically set at a gap close to the material thickness. The plunge (roll gap) varies from being deepest at the entry and shallow at the exit. Since all the rolls are on the same center distance (pitch) and all are the same diameter, the strip bend radius at each roll mesh progressively increases from smallest radius at entry to very large radius at exit.

The rate at which the strip bend radius changes from roll mesh to roll mesh, is a function of the roll center distances and the fact all the rolls are the same diameter. This in turn sets the horsepower required to do the leveling work.

However, if the entry rolls can be positioned to a tighter roll gap (entry plunge) independent of the rest of the rolls, then the work at the entry is disproportionately higher vs the rest of the rolls. This results in lower work required at the rest of the rolls which lowers the total horsepower required.

For example, a configuration would include 6.75 inch diameter work rolls oriented on eight inch centers, with five upper work rolls and six lower work rolls. Also, five yield strains are induced in a strip that is 0.625 inches thick and 53,000 psi yield strength. This results in a required bend radius of R=t*E/(2*NS*YS). That is, R=0.625*30000000/(2*5*53000)=35.38 inches. For the conventional leveler, the entry roll gap would be 0.508 inches. In fact the successive gaps would be 0.508 inches, 0.534 inches, 0.557 inches, 0.580 inches, and 0.602 inches. This in turn sets the horsepower required.

With an eccentric configuration, a 0.508 inch gap is achieved at the entry but other gaps can be more open or larger. For example, in an eccentric configuration of 0.030 inches, the gaps would be 0.508 inches, 0.564 inches, 0.577 inches, 0.590 inches, and 0.602 inches. The larger roll gaps result in larger bend radii imparted to the strip, which means less bending work which in turn means less horsepower than the conventional approach.

In both cases there is the same amount of work is being performed at the 0.508 inch location, but for the other work rolls there is less bending work with the eccentric geometry, therefore less horsepower.

Alternatively, large work rolls 21, 36 can be used in combination with small work rolls 90, 91 positioned in series with the large rolls 21, 36. This extends the working gauge of the leveler without having to change out cassettes or without needing two levelers.

Referring to FIG. 4, it can be seen that the back-up rolls 22, 24 includes a number (flight 25) of narrow face rolls that are mounted on back-up support beams 26 that transmit the work roll separating forces to the upper leveler housing.

Referring now to FIG. 5, an upper bank 21*b* of a plurality of separately driven large work rolls 21 is supported at opposite ends of the rollers by journal beams 29, 31. In one embodiment of the disclosure, the upper work roll journals 29, 31 are retained vertically by locks or clamping members 30, 32 as shown in FIG. 3. In the across machine direction, the upper work roll journals 29, 31 are constrained by gibs 61, 63 to prevent side shifting of the work rolls in the across machine direction. In other embodiments, the upper work roll journal beams use cylinders for the vertical clamp. Gibs, however, are still used for the across machine retention. The upper work rolls do not shift vertically or arcuately during operation. The above described clamps are utilized for quick roll change of the work rolls.

Referring to FIG. 5, a lower bank 34 of separately driven large diameter work rolls 36 is shown with opposite ends journalled in journal beams 37, 39. The journal beams are fitted in gibs to permit vertical and/or arcuate movement. It will be observed that work rolls 21 of upper bank 21*b* are spaced to nest between pairs of lower work rolls 36 in lower bank 34.

Referring to FIG. 4, lower back-up rolls 38, 40 are in working position to ride and support the outer diameter of lower work rolls 36.

For purposes of illustration of this embodiment, the work roll larger diameter (work rolls 21, 36) (i.e., about 6.75 inches) is about twice the work rolls 90, 91 smaller diameter (i.e., about 3 inches); however, other sizes of large and small work roll diameters could be used without departing from the scope of the disclosure. Correspondingly, in this embodiment, the pitch for the larger diameter is essentially twice the pitch for the smaller diameter; however, other variations of pitch can be used without departing from the scope of the disclosure.

Figure 5B:
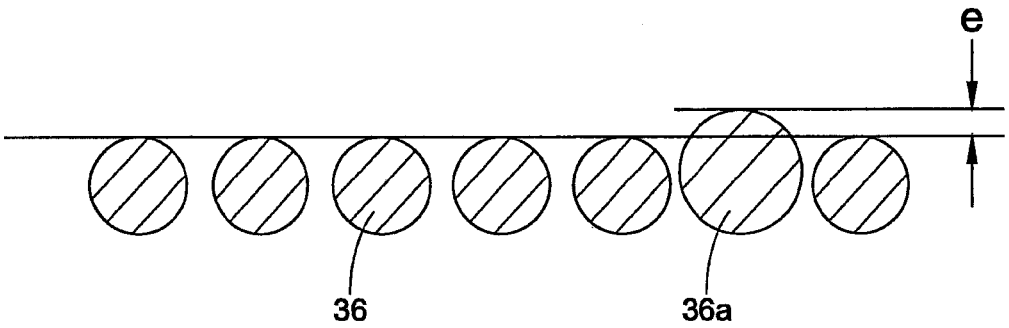
FIG. 5B illustrates an eccentric work roll configuration for lower work rolls.
Figure 6:
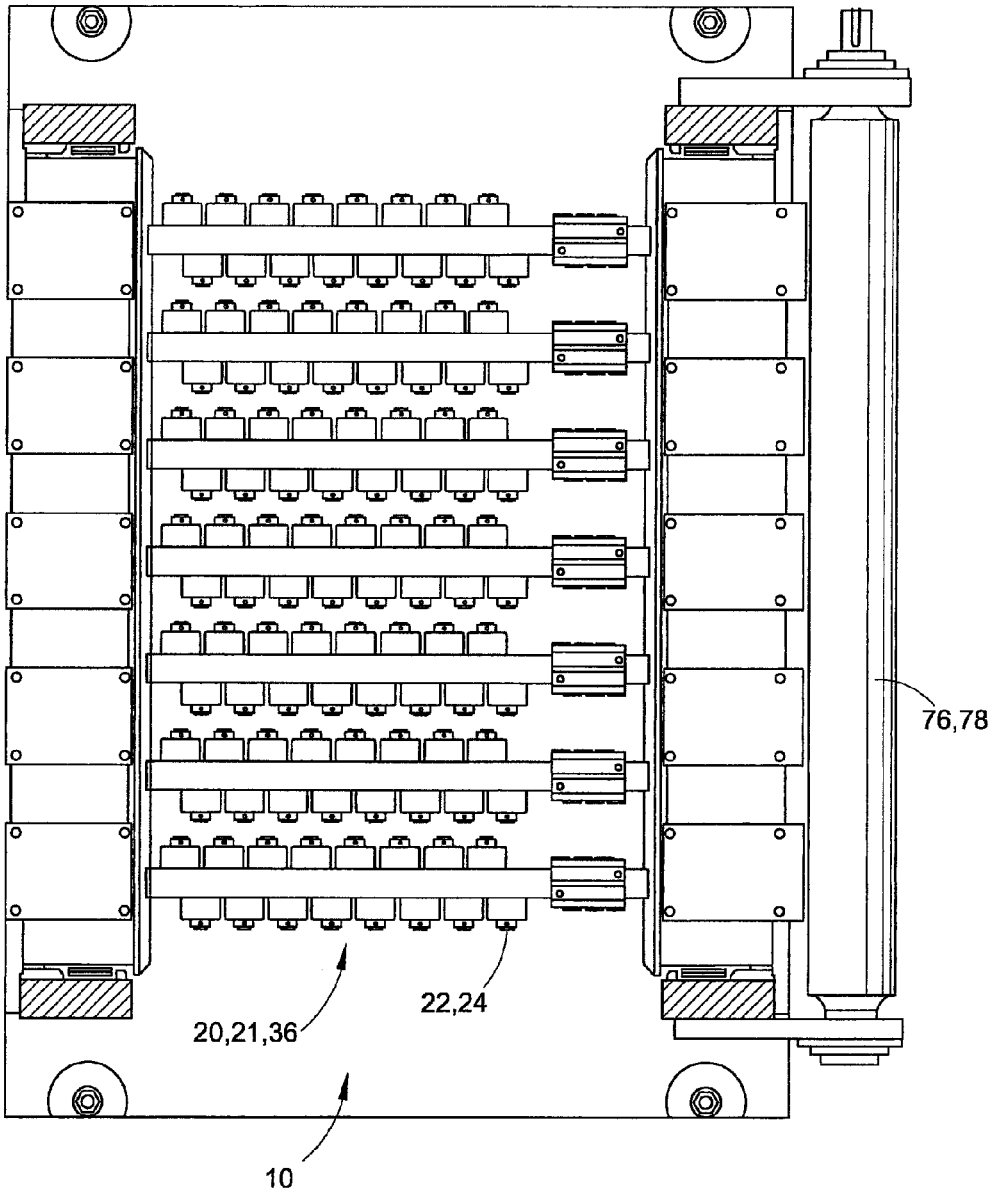
FIG. 6 is a top plan view of the roller leveler of FIG. 1.
Figure 7:
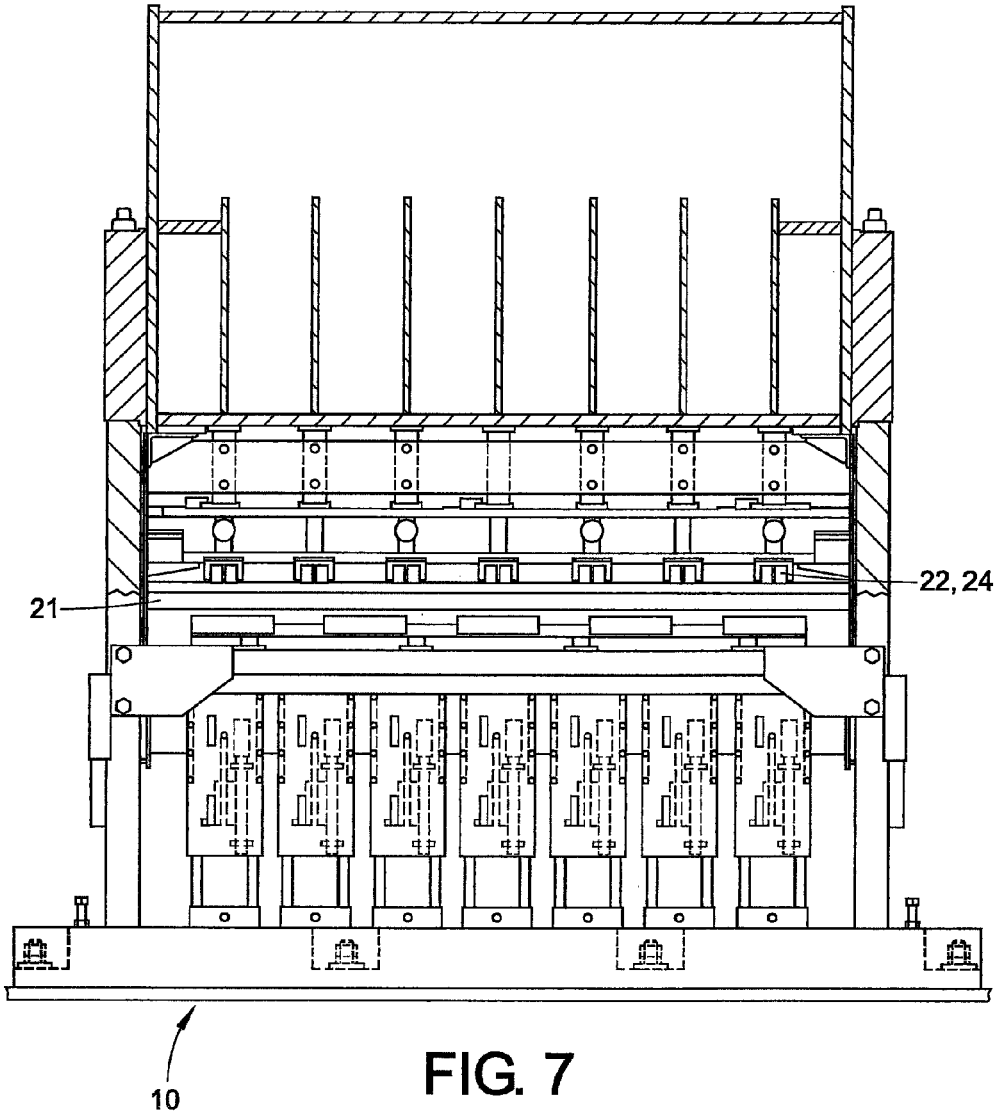
FIG. 7 is another cross-sectional front view of the leveler of FIG. 1.

Referring now to FIG. 5B, one of the work rolls 36*a* can be larger in diameter than the rest of the work rolls 36. This creates a deeper bend radius locally at roll 36*a*, thereby reducing the total work required in the rest of rolls 36, thereby reducing overall required horsepower.

Referring to FIG. 3, small diameter upper and lower work rolls 91, 90 are positioned near the entry point 110 before or in series with the larger diameter upper and lower work rolls 21, 36 which are positioned near exit point 108 along the path of strip travel. The small rolls 90, 91 thus transition to the large work rolls 21, 36. Both sets of rolls 90, 91 and 21, 36 can be used at the same time. For example, for light gauge material, all of the work rolls 21, 36, 90, 91 are used and engage the strip. For heavy gauge materials, only the large diameter rolls 21, 36 are used. That is, the small diameter rolls 90, 91 are physically shifted or moved out of the strip travel path such as by lifting a small roll housing 69 connected to rotating hydraulic arm 101.

The small diameter rolls 90, 91 and large diameter rolls 21, 36 necessarily rotate at a different RPM. Back-up rolls 93 of a smaller diameter than rolls 91, 90 can also be used to engage rolls 91, 90. Thus, there is a configuration where there are large diameter upper and lower work rolls 21, 36 near the exit port 108 and small diameter upper and lower work rolls 91, 90 near the entry port of the leveler 110 level strip metal. This configuration is for leveling light gauge type metal. A second configuration results from moving the small diameter work rolls 90, 91 out of the travel path so that only large diameter work rolls 21, 36 contact and level heavy gauge strip material.

In accordance with another aspect of the disclosure, referring to FIG. 5B, some or one of the large rolls 36*a* are oriented in an eccentric or offset configuration with respect to other rolls 36 which results in the highest degree of flatness and memory reduction. For example, the eccentric or offset roll configuration can result from a roll or some rolls having different diameters (as seen in FIG. 5B) or rolls are physically located at a lower position (as seen in FIG. 5A) permanently or temporarily to change the plunge. The leveler utilizes individual work roll drives, such that the unlikely failure of one or more work roll drive trains only marginally reduces leveler capacity, allowing the leveler to continue operating so that maintenance can be performed at a time that won't interfere with production requirements.

Another aspect of the disclosure is the roller leveler includes an injector system for quick and easy removal and insertion of work rolls 20, 21, 36 and back-up rolls, as well as a zero nesting feature which provides automatic self-calibration assuring quick and accurate leveling repeatability.

There are lower back-up roller mounting beams 54 evenly spaced along the span of the lower work rollers 36, each mounting beam carrying a flight of lower back-up rollers 38, 40 extending from front to rear of the roller leveler. The back-up rollers are spaced so that each flight provides two back-up rolls in tangential contact with each lower work roll. The back-up rollers may not be in line across the width of the support beam. They are staggered, so only two back-up rollers are in tangential contact with the work roll. Except for the outboard, back-up rolls, forward and rearward of each flight, the intermediate back-up rolls are each in shared tangential supporting contact with a pair of work rolls 36.

Referring to FIG. 4, a hydraulic cylinder 56 is mounted under each lower back-up roll mounting beam 54. Actuation of hydraulic cylinders 56 will cause lower back-up roll mounting beam 54 to shift vertically and/or arcuately to bring lower back-up roll housing upward resulting in lower back-up rolls 38, 40 being into tangential pressure contact with adjacent lower work rollers 36. Lower back-up rolls 38, 40 can also be moved via housing 41 out of the way if rolls 36 are to be replaced.

Similarly, as shown in FIG. 2, there are upper back-up roll mounting beams 26 evenly spaced along the span of upper intermediate rolls 20 and work rollers 21. Each mounting beam 26 carries a flight of upper back-up rolls 22, 24 arranged front and rear of the rollers for tangential contact therewith. The flights of upper back-up rolls are aligned from front to rear of the roller leveler. A flight of upper back-up rolls are mounted on each back-up roll mounting beam 26. The upper back-up rolls are also positioned so that each flight provides two back-up rolls in tangential contact with each upper intermediate roll 20 and intermediate roll 20 supports work roll 21. Cylinders 46, 48 are used to hole the complement of intermediate rolls 20 and work rolls 21 up against the back up rolls 22 and 24.

Furthermore, in accordance with a further aspect of a preferred embodiment of the disclosure, each work roll 21, 36, 90, 91 can have an independent work roll drive system thus enabling different work roll diameters to be simultaneously engaged and running at different rpm. This extends the working gauge range of the leveler without having to change out roll cassettes or without requiring two separate levelers.

Each work roll has its own motor and independent gear reduction allowing each roll to load share and turn at the exact speed dictated by the roll's plunge setting. Distribution box and spindle wind up is a problem for other pinion stand and split pinion stand levelers, but not for the roller leveler of the present disclosure. The leveler doesn't require mechanically locked sets of gears, but instead uses common off-the-shelf lower horsepower motors and independent gearing. The exclusive feature provides inter-roll tension between all work rolls, greater energy efficiency, uptime redundancy and eliminates strip marking due to slippage.

Figure 10:
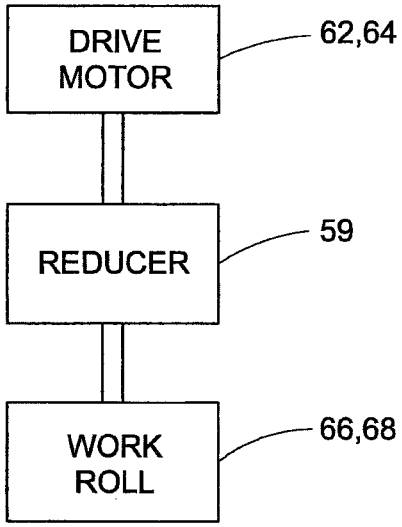
FIG. 10 is a schematic of the roller leveler having a drive motor for each separate work roll.
Figure 8:
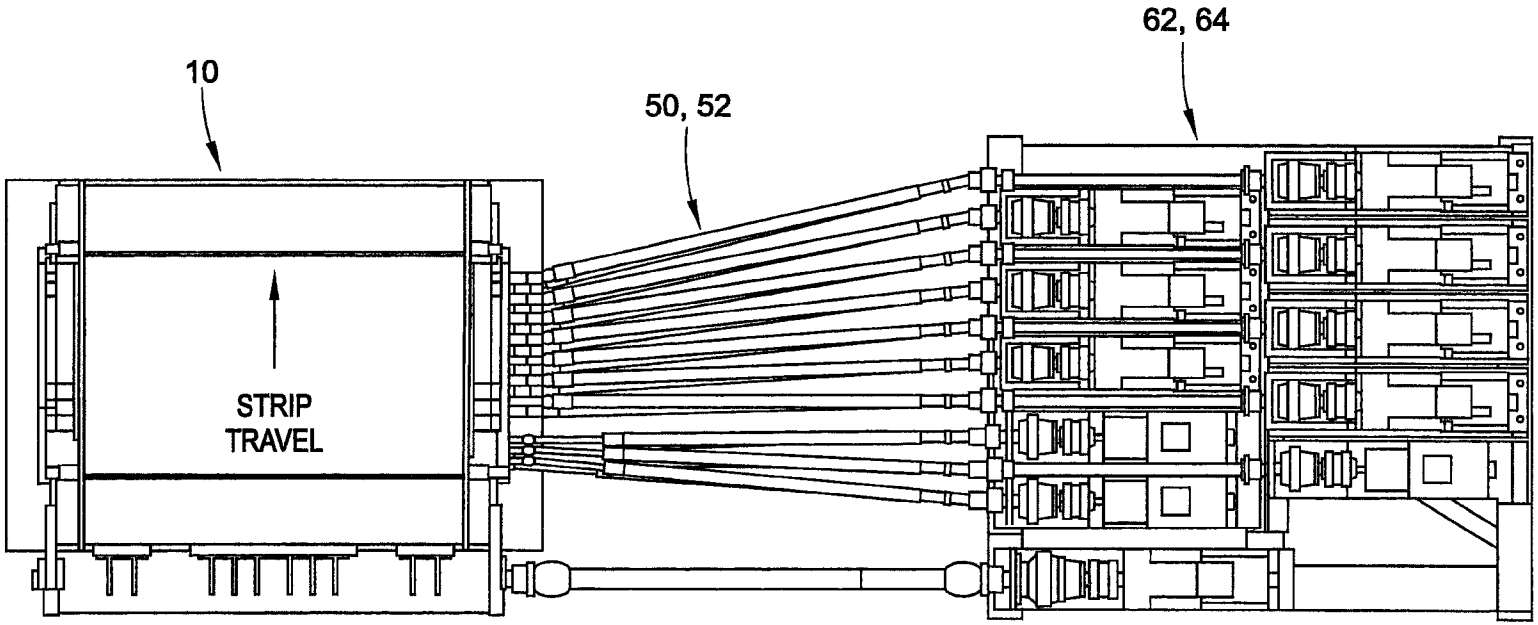
FIG. 8 is a top plan view of the roller leveler of FIG. 1 showing the drive trains for the work rolls.
Figure 9:
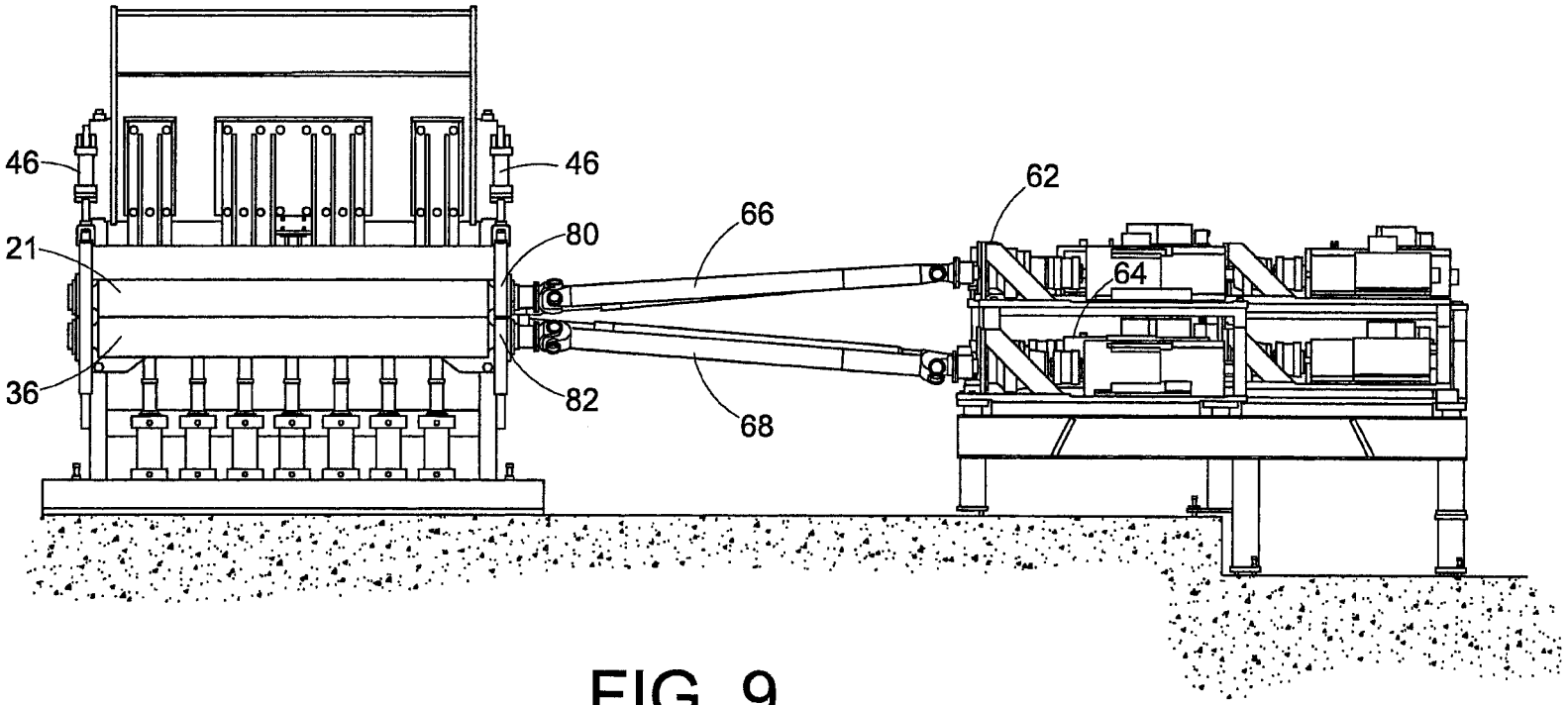
FIG. 9 is a front elevational view of the roller leveler and drive system.

Specifically, the rollers 21, 36 are each independently driven or rotated by any suitable electro-motorized means, such as in drive shafts 50, 52 attached to electro-motors 62, 64 and reducers 59 shown in FIGS. 8, 9, and 10. The drive motors 62, 64 have drive arms 66, 68 attached to mounting members 80, 82 of the rollers 21, 36. The arms can pivot as the rolls travel up and down vertically. The movement of the sheet in turn moves or rotates the work rolls as it passes through the rolls.

Referring to FIG. 3, a feed or entry roller at entry point 110 having upper arm 72 and lower arm 74 with entry rollers 76, 78 are pivoted into contact or close proximity by hydraulic arm 70.

One aspect of the disclosure is the injector system which facilitates maintenance of the work rolls. The upper and lower flights of backup rolls are also easily removed from the leveler for off-line inspection and maintenance purposes.

Another aspect of the disclosure is the individual work roll drives of the roller leveler turn at exactly the speed indicated by the plunge setting, each using its own motor, but with a controller torque. In fact, the roller leveler controls the torque of its work rolls so that those rolls needing the least (i.e., at the exit) help those with the heaviest torque (i.e., at the entry) by pulling tension in the strip. This system differs from that of distribution box levelers, where there is compression of the strip between the work rolls, with each roll resisting the higher speed of the previous roll. This compression runs counter to the tension required to stretch the strip around a work roll while eliminating shape defects. Whereas the inner-roll tension of the roller leveler of the present disclosure enhances the effect of leveling, the inner-roll resistance of other traditional levelers degrades it and sacrifices efficiency while doing so. The failure of a reducer or drive motor of the roller leveler temporarily reduces the available power to correct shape by less than 10% (i.e., about one out of eleven or seventeen work rolls). The failure of a traditional leveler distribution box or motor, results in the leveler being out of service.

The roller leveler is used on a process line for a range of materials, for example metals such as steel, aluminum, stainless steel, metal ribbon, etc.

The exemplary embodiment has been described with reference to the preferred embodiment. Obviously, modifications and alterations will occur to others upon reading and understanding the preceding detailed description. It is intended that the exemplary embodiment and appended claims be construed as including all such modifications and alterations.

The invention claimed is:

1. A roller leveler for leveling strips of metal, comprising:

a frame;

a first bank of upper and lower work rolls journalled in said frame via a first housing positioned near an exit portion of said leveler, wherein said first bank of upper and lower work rolls have an offset configuration wherein there is a first number of said lower work rolls and a second number of said upper work rolls, wherein said first number is different than said second number;

a bank of upper and lower back-up rolls in contact with said upper and lower work rolls to support said upper and lower work rolls of said first bank, wherein said upper and lower back-up rolls have a different diameter than said upper and lower work rolls;

said bank of upper and lower back-up rolls mounted to said frame via back-up housings;

a second bank of upper and lower work rolls journaled in said frame via a second housing positioned near an entry portion of said leveler; and wherein said upper and lower work rolls of said first bank have a different larger diameter than said upper and lower work rolls of said second bank; and wherein said first bank of upper and lower work rolls and said second bank of upper and lower work rolls are both engaged for leveling light gauge strip; and wherein said second bank of upper and lower work rolls are moved out of a strip travel path by lifting said second housing via a movable arm such that only said first bank of upper and lower work rolls are engaged for leveling heavy gauge strip.

2. The roller leveler of claim 1, wherein said first number of said lower work rolls of said first bank is an even number of said lower work rolls and said second number of said upper work rolls of said first bank is an odd number of said upper work rolls.

3. The roller leveler of claim 1, wherein said first number of said lower work rolls of said first bank is an odd number of said lower work rolls and said second number of said upper work rolls of said first bank is an even number of said upper work rolls.

4. The roller leveler of claim 1, wherein a diameter of said upper and lower work rolls of said first bank is larger than a diameter of said upper and lower work rolls of said second bank.

5. The roller leveler of claim 1, wherein each of said upper and lower work rolls of said first bank of upper and lower work rolls and said second bank of upper and lower work rolls has an independent drive system.

6. The roller leveler of claim 5, wherein each of said drive systems comprises a drive motor and a gear reduction system.

7. The roller leveler of claim 6, wherein each of said drive systems is each mounted via drive shafts to mounting members of said upper and lower work rolls of said first bank and second bank of upper and lower work rolls.

8. The roller leveler of claim 7, wherein each of said drive systems can rotate each of said upper and lower work rolls of said first bank and second bank of upper and lower work rolls at different speeds of rotation.

9. A roller leveler comprising:

a frame;

a first bank of upper and lower work rolls of a first diameter positioned near an entry point portion of said frame; and a second bank of upper and lower work rolls of a second diameter larger than said first diameter; said second bank of upper and lower work rolls is positioned near an exit point portion of said frame and adjacent said first bank, wherein at least one of said upper and lower work rolls of said second bank is mounted offset from another of said upper and lower work rolls of said second bank via one of a vertically offset position and a larger diameter than said another of said upper and lower work rolls of said second bank and wherein both of said first bank of upper and lower work rolls and said second bank of upper and lower work rolls engage a light gauge strip of metal and wherein a housing containing said first bank of upper and lower work rolls is moved out of a strip travel path by a movable arm so that only said second bank of upper and lower work rolls engage a heavy gauge strip of metal and wherein at least one of said upper and lower work rolls of said second bank is mounted to be offset from another of said upper and lower work rolls of said second bank via one of a vertically offset position and a larger diameter than said another of said upper and lower work rolls of said second bank.

10. The roller leveler of claim 9, wherein said first bank and said second bank of upper and lower work rolls are positioned in series with respect to each other.

11. The roller leveler of claim 10, wherein each of said upper and lower work rolls of said first and second banks has an independent drive system.

12. The roller leveler of claim 11, wherein each of said drive systems comprises a drive motor and a gear reduction system.

13. The roller leveler of claim 12, wherein each of said drive systems is mounted via drive shafts to mounting members of said upper and lower work rolls of said first bank and said upper and lower work rolls of said second bank.

14. The roller leveler of claim 13, wherein each drive system can rotate each of said upper and lower work rolls of each of said first and second banks at different speeds of rotation.

* * * * *